US005496254A

United States Patent [19]

Keller et al.

[11] Patent Number: 5,496,254

[45] Date of Patent: Mar. 5, 1996

[54] LAB CENTRIFUGE WITH IMBALANCE SHUTOFF

[75] Inventors: Bernd Keller, Borsdorf; Matthias Meyer, Ammelshain, both of Germany

[73] Assignee: Gerätebau Eppendorf GmbH, Engelsdorf bei Leipzig, Germany

[21] Appl. No.: 322,611

[22] Filed: Oct. 13, 1994

[30] Foreign Application Priority Data

Oct. 15, 1993 [DE] Germany ..... 43 35 119.0

[51] Int. Cl.[6] ..... B04B 13/00

[52] U.S. Cl. ..... 494/7; 494/10; 494/16

[58] Field of Search ..... 73/457, 460, 462; 494/1, 7, 9, 10, 11, 12, 16, 82, 84; 210/144, 363; 318/460, 470; 68/23.1, 23.3, 12.06

[56] References Cited

U.S. PATENT DOCUMENTS

| | | | |
|---|---|---|---|
| 2,895,023 | 7/1959 | Blum | 494/16 X |
| 3,676,723 | 7/1972 | Drucker | 494/82 X |
| 4,099,667 | 7/1978 | Uchida | 494/7 |
| 4,214,179 | 7/1980 | Jacobson et al. | 494/84 X |
| 4,491,019 | 1/1985 | Wicki et al. | 494/7 X |
| 4,700,117 | 10/1987 | Giebeler et al. | 494/7 X |
| 4,910,502 | 3/1990 | Serveau et al. | 210/144 X |
| 4,972,110 | 11/1990 | Gorodissky et al. | 494/10 X |
| 5,160,876 | 11/1992 | Niinai et al. | 318/460 |

FOREIGN PATENT DOCUMENTS

| | | | |
|---|---|---|---|
| 0082956 | 7/1983 | European Pat. Off. . | |
| 1780185 | 12/1958 | Germany . | |
| 216868 | 1/1985 | Germany | 494/10 |
| 3929792 | 3/1990 | Germany . | |
| 1156740 | 5/1985 | U.S.S.R. | 494/10 |
| 2146784 | 4/1985 | United Kingdom | 494/10 |

*Primary Examiner*—Charles E. Cooley
*Attorney, Agent, or Firm*—Walter C. Farley

[57] ABSTRACT

A lab centrifuge with a rotor carrying vessel supports and a motor with a vertical shaft driving said rotor into rotation, the stator associated with said rotor being supported by elastic supports on a centrifuge base. A shutoff device controls the motor which it shuts off in response to a signal generated by a component affixed to the stator and a component affixed to the base when the stator deviation taking place is found to exceed or match the maximum admissible threshold imbalance. One of the two components is a field generator generating a constant field and the other component is a field intensity detector connected to an analyzer which, upon limit changes in field intensity caused by the deviation, implements shutoff.

6 Claims, 2 Drawing Sheets

12
13
+ -
SENSOR
11
7
20
21
22
ADC
23
24
25
24a
24b
26
38
37
41
39
42
MEM.
MEM.
40
46
45
36
EVENTS
1, 2, 3
19
INTERPOL.
43
35
DISPLAY
9
44
47
MEM.
29
10
28
COMPARATOR
27
34
30
33
SHUT OFF
31
32
34

LAB CENTRIFUGE WITH IMBALANCE SHUTOFF

FIELD OF THE INVENTION

This invention relates to a laboratory centrifuge having a detector for detecting motion due to imbalance in the rotation of the centrifuge and a shutoff to deactivate the centrifuge at a predetermined threshold imbalance.

BACKGROUND OF THE INVENTION

In laboratory centrifuges, the rotor, i.e., the part of the structure which rotates and which carries a vessel with material to be subjected to centripetal force, is balanced at the time of manufacture. Nevertheless, in the event of a defect or of uneven loading of the vessel, an imbalance may arise that can be tolerated only within specific limits. Otherwise, damage may occur when operating the centrifuge, especially at high speeds.

Accordingly, centrifuges of this kind are equipped with shutoff devices for turning the motor off when an upper threshold imbalance, empirically ascertained for the particular centrifuge, is exceeded.

However, ascertaining the imbalance arising at centrifuge startup entails difficulties.

The state of the art comprises highly costly shutoff devices which typically operate using magnetic-field detectors to monitor the rotor-generated magnetic fields and to thereby determine the imbalance.

Known centrifuges have been marketed by applicant's assignee for many years in which a mechanical switch is mounted on the housing and, upon rotor imbalance and lateral deviation, the switch makes contact with an element mounted on the stator which then actuates the shutoff switch. This design, however, incurs two substantive drawbacks. On one hand, mechanical switches may fail per se and on the other hand the switch or the element on the stator must be adjusted to assure that switching off takes place accurately at the specific threshold imbalance. Assembly costs are raised as a result. Furthermore, the deviation depends on support tolerances and therefore will differ among units of the same type at the same imbalance.

SUMMARY OF THE INVENTION

An object of the present invention is to provide a centrifuge having an imbalance shutoff switch which allows economical manufacture while providing long-term reliability.

A further object is to provide a centrifuge control in which imbalance is determined in a simple manner essentially from lateral deviations in the stator motion which are large at low speeds and can be measured relatively easily. Briefly described, the invention includes a lab centrifuge having a base, a centrifuge rotor with vessel supports and a motor with a vertical shaft driving the centrifuge rotor into rotation, the motor including a stator. Elastic supports support the stator on the base. A stator deviation detector includes a stator-carried component and a component fixed to the base for detecting non-rotary stator deviation from a rest position and producing a signal indicating the deviation, one of the detector components comprising a field generator generating a constant field and the other component comprising a field intensity detector. A control means supplies electrical power to the centrifuge and includes an analyzer responsive to the deviation signal for deenergizing the centrifuge at a predetermined maximum permissible threshold deviation. The analyzer includes calibration means for ascertaining an amplitude of centrifuge threshold imbalance during calibration and storing the amplitude as a limit amplitude in a permanent memory of said analyzer and means for determining amplitudes of detected field intensity and comparing those amplitudes to the limit amplitude.

BRIEF DESCRIPTION OF THE DRAWINGS

Certain embodiments of the invention will be described with reference to the following drawings wherein.

DESCRIPTION OF THE PREFERRED EMBODIMENTS

Figure 1:
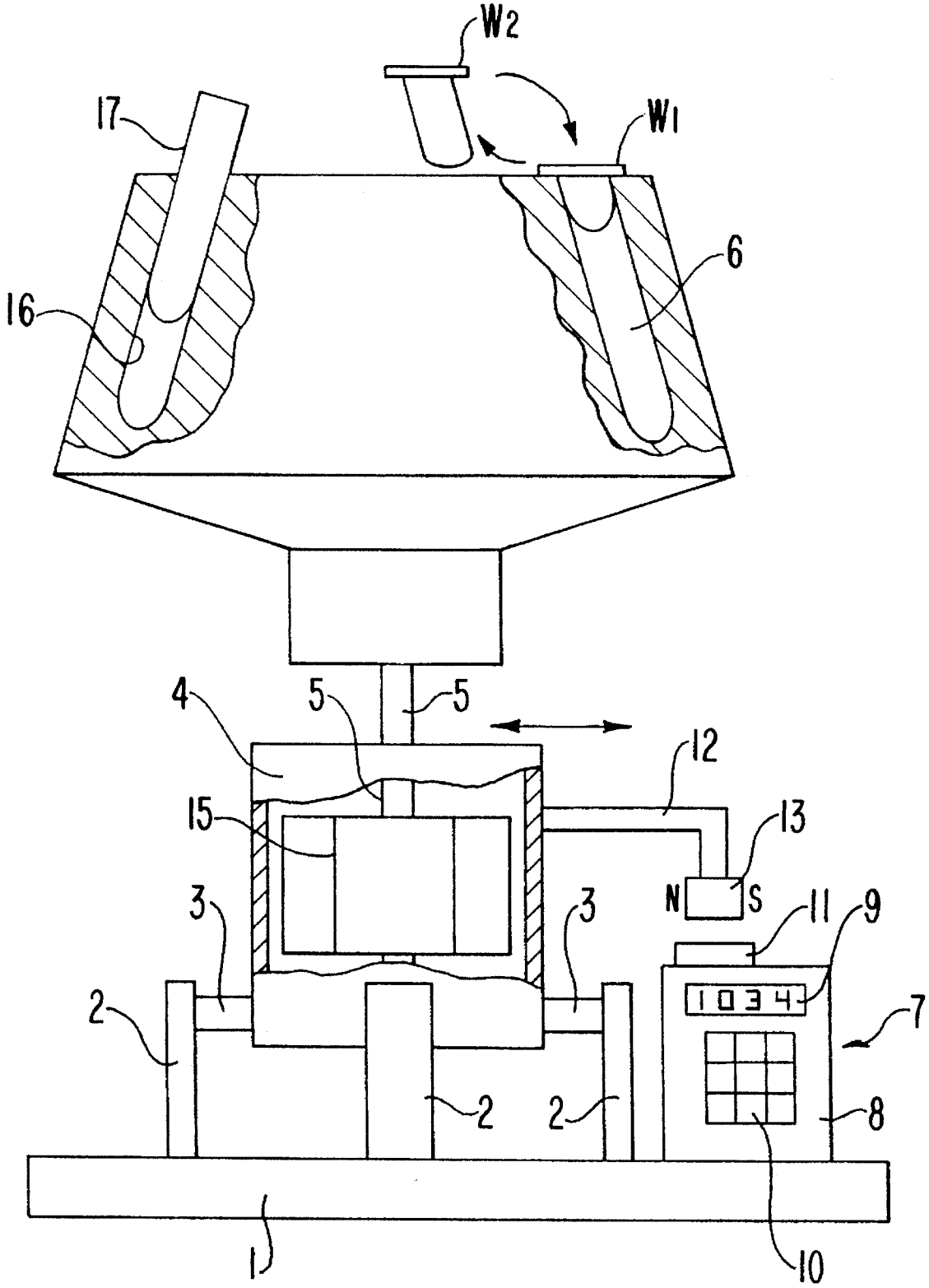
FIG. 1 is a schematic side elevation of a lab centrifuge incorporating apparatus in accordance with the invention.

In accordance with the invention, when the stator moves laterally in an elastic support because of imbalance, the stator and a fixed base move relative to each other. A field-generating component mounted on either the stator or the base thus moves relative to a field intensity detecting component mounted on either the base or the stator. Thus, the field-intensity detector is exposed to different field intensities. The changes in field intensity generated by lateral, especially radial, motion of the stator because of imbalance are appropriately measured by an analyzer. Absolute values of the changes, as well as the acceleration, can be analyzed. When predetermined values are reached or crossed, the analyzer shuts the motor off. Advantageously, the invention avoids using movable mechanical components because neither the field source nor the field-intensity detector require mechanical components. Advantageously, a field-intensity detector is able to ascertain motion-caused field changes at arbitrary distances from the field source, within broad limits. Precise adjustment of the two components relative to each other is not required. As a result, centrifuge manufacture is made more economical. Nor is the analysis dependent on absolute deviation values, and accordingly it is possible, using rationalized algorithms, to match the particulars to maintain very accurate shutoff conditions. Illustratively the analysis may be such that short-term crossing of predetermined threshold values will be tolerated and shutoff will take place only upon exceeding said threshold value after some time or upon recurrence.

Amplitude analysis is implemented in an especially easy manner even in the presence of complex signal shapes of the field-intensity changes.

Permanent magnets and Hall generators are commercially available, exceedingly economical and evince long-term reliability.

The field source, for instance a permanent magnet and hence requiring no connections, is mounted on the stator, whereas the field-intensity detector, which does require connections to the analyzer, is mounted on the housing where it may be integrated into an electronics board present anyway. As a result, manufacturing costs are lowered.

The analyzer can prescribe a fixed limit amplitude for all centrifuges of the same model. However, manufacturing tolerances would then entail some problems. For instance, the elastic stator supports which are necessary to absorb lesser and still permissible imbalances comprise tolerances, especially where economical centrifuges are concerned. As a result, the stator would deviate to different extents even when the imbalance is still within limits, and thus different amplitudes would be experienced. If one fixed limit amplitude is set for all centrifuges, the shutoff would take place at different imbalances, and this eventuality is undesirable. In this analyzer design, the centrifuge may be operated while being calibrated at the threshold imbalance, for instance by placing a test weight W1 in one of the vessel supports. In the process, the calibration device advantageously ascertains the resulting amplitude in order to create reproducible conditions which the calibration device prescribes to the motor control. The amplitude determined in calibration is stored as being the limit amplitude in the analyzer and thus is available to it in later centrifuge operation for its monitoring function of this limit amplitude.

A desirable form of the calibration device allows two calibration tests with different test weights, W1 and W2 one of which W1 generates an imbalance below the threshold and the other W2 an imbalance above. This procedure assures that during calibration, the centrifuge is operated once with the imbalance within the safe region and another time with this imbalance in the tolerance zone above the threshold imbalance. As a result the calibration assures that the centrifuge and its analyzer operate reliably within the tolerance zone of the threshold imbalance. A third test run otherwise required with a test weight precisely matching the threshold imbalance is eliminated in this design of the calibration device because the limit amplitude is now determined by interpolating the two test runs described above and said limit amplitude then can be stored in the analyzer device.

Referring now to the drawing, several posts 2 are mounted on a base plate 1 and by means of elastic support members 3, which can be rubber blocks or pads, hold a centrifuge stator 4 which is the housing of an electric motor which has a motor rotor 15 in either case, or a housing which contains the motor.

The electric motor included in stator 4 comprises a vertical rotatable shaft 5 carrying a centrifuge rotor 6 having the conventional contour of lab centrifuges. Conventional vessel supports 16 are present inside centrifuge rotor 6 which is accessible through an upper opening for insertion and removal of conventional receptacles 17 in a well-known manner.

For clarity, a safety housing enclosing the entire shown apparatus and comprising an access flap to the topside of rotor 6 is omitted.

An electronics unit 7 is mounted on base plate 1 and comprises an externally accessible front panel 8 with a display 9 and a keypad 10.

Electronics unit 7 comprises a tachometric control system of the electric motor in the stator 4 and, by input from keypad 10 and display 9, allows the desired tachometric (speed) control of the centrifuge.

Electronics unit 7 carries a Hall-effect device or Hall generator 11 which illustratively may be integrated on an electronics board normally present in said unit. Hall generator 11 is stationary relative to base plate 1 and is connected by conventional electrical connectors to an analyzer in electronics unit 7.

A permanent magnet 13 is mounted on an arm 12 fixedly attached to stator 4 in the vicinity of the Hall generator 11. Fine control is not required in this set-up. Positional deviations caused by assembly tolerances or tolerances of supports 3 will not interferė because even in the case of deviating gaps, Hall generator 11 will sense the magnetic field generated by the permanent magnet 13.

For sake of simplicity, the analyzer in the electronics unit 7 is not shown in the drawing; it receives signals from the Hall generator of which the strengths depend on the magnetic field intensity at the location of detector 11.

When the centrifuge is at rest, Hall generator 11 senses a time-constant field. When the centrifuge rotation is started and imbalances occur, stator 4 deviates from its rest position in the supports 3. Such deviations are especially large at low speeds in the vicinity of the support resonance and can be well analyzed in that vicinity. In the course of these deviations, arm 12 undergoes displacements having radial components in the direction of the double-headed arrow shown next to the arm 12 in the Figure. These arm displacements result in reciprocating motion of permanent magnet 13 relative to Hall generator 11 and create alternating changes in magnetic field intensity at detector 11.

Accordingly, the analyzer connected to Hall generator 11 receives an AC signal that can be analyzed as desired. Preferably, the signal amplitudes are used as the measure of the imbalance.

A permissible limit amplitude may be stored in a permanent memory, for instance an EEPROM located in the analyzer, which constantly compares the limit amplitude with the momentary measured amplitude. If the limit amplitude is crossed upward, the analyzer initiates motor shutoff through electronics unit 7 and its motor controlling devices. The limit amplitude can be determined empirically for specific centrifuge models and be stored in electronics unit 7. This procedure makes shutoff possible every time at a specific amplitude of deviation.

However, the shutoff preferably is carried out not for specific deviations by the stator 4 but at a specific imbalance, called the threshold imbalance, of centrifuge rotor 6. For that purpose the electronics unit 7 may be fitted with a calibration device summoned for instance by means of a service code fed in at the keypad 10. The design of the calibration device is such that it demands on the display 9 that calibration be carried out. For this purpose, such a test weight is placed in the rotor 6 to cause centrifuge rotor to reach the level of the threshold imbalance. The calibration device then determines the resulting signal amplitude which it stores in the permanent memory of the analyzer to be available thereafter.

In another embodiment, the calibration device demands two calibration tests carried out with two different test weights, one of which W2 generates imbalance below and the other W2 above the threshold imbalance. The calibration device ascertains the signal amplitudes generated in both calibration tests by the Hall generator 11 and then stores a computed interpolated value as the limit amplitude.

As regards this double calibration, for instance with a centrifuge model guaranteeing a permissible threshold imbalance of 2.5 g determined in preliminary tests, a calibration test may be carried out at W13 2.2 g (gram) and another at W22 2.9 g. A threshold imbalance corresponding to an imbalance of 2.5 g is obtained by interpolation.

If the two calibration tests, in particular with one test weight above the threshold imbalance, as described above, are selected within the range of tolerance of the centrifuge, proper operation of the centrifuge in the range of tolerance about the guaranteed threshold imbalance is checked.

Compared to the above described embodiment, variations may be introduced concerning permanent magnet 13 and Hall generator 11. In the embodiment shown, permanent magnet 13 is located above Hall generator 11. However, the two components 11, 13 also may be mounted side by side. The most advantageous configuration to detect the deviations of stator 4 can be found empirically and illustratively may depend on the stator support design. Moreover, Hall generator 11 may be mounted on arm 12 and permanent magnet 13 may be rigidly affixed to the housing, that is to base plate 1.

Again, other than magnetic fields may be used to detect relative motion between components 11 and 13. Illustratively component 13 may generate an electrostatic field which can be detected by component 13. Accordingly, components 11 and 13 might act in the manner of an electric capacitor. Furthermore, electromagnetic AC fields such as light might also be used. One of the components 11, 13 would a light source and the other a photo-detector.

Figure 2:
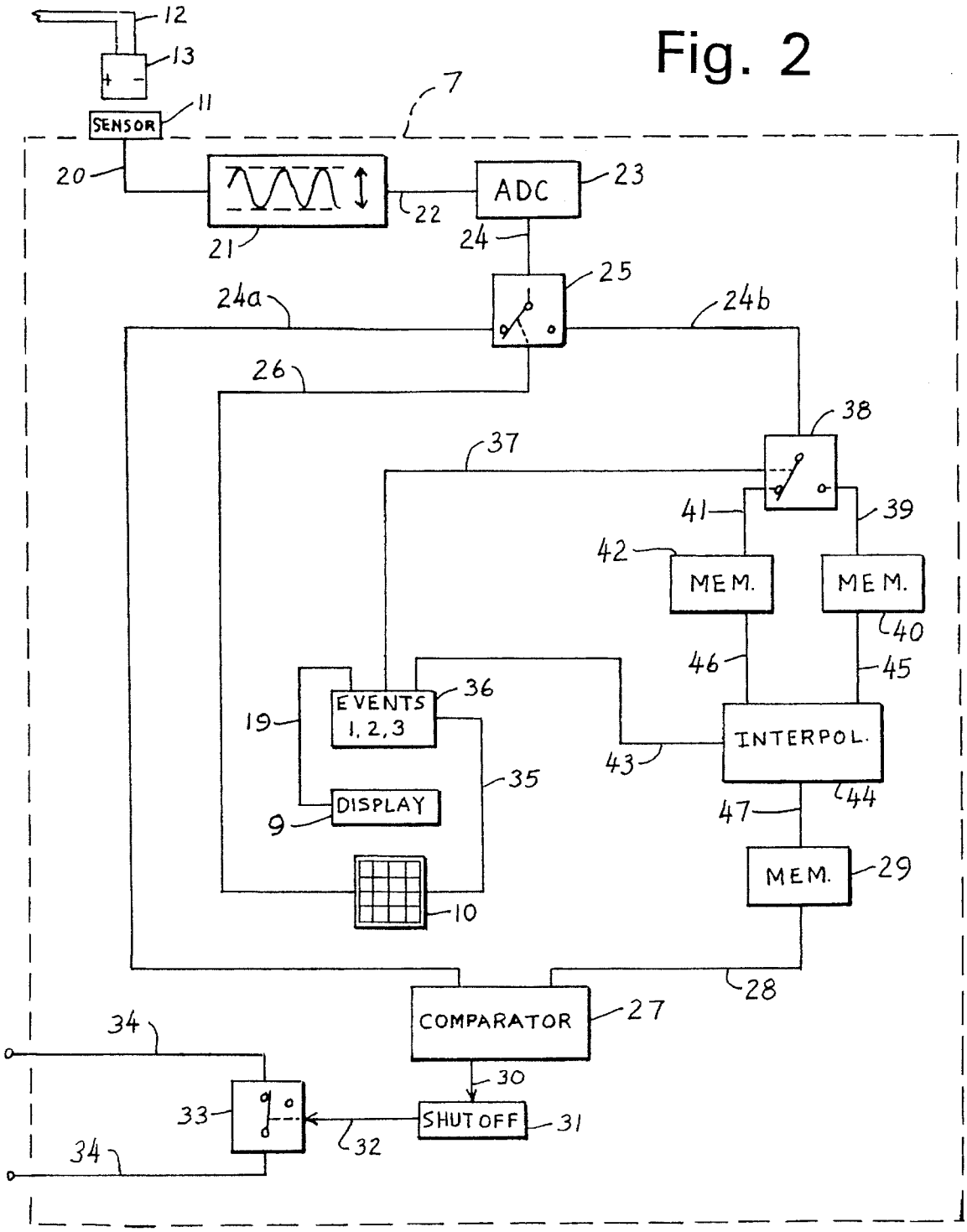
FIG. 2 is a schematic block diagram showing an electronic unit for control of the centrifuge of FIG. 1 in accordance with the invention.

FIG. 2 shows an embodiment of an electronics unit usable as unit 7 of FIG. 1. The electronics unit has two modes of operation. In the first mode, for routine operation of the centrifuge, the circuit watches the deviation of stator 4 and shuts off the motor when the limit amplitude is reached. In the second mode, for a calibration test, it measures the amplitudes for two test runs and interpolates between the measured values to find the limit amplitude.

FIG. 2 shows the electronic components in a rather simplified way, showing only the logical units necessary to understand the manner of construction and operation of unit 7. The inner construction of the individual units are conventional and are not shown for simplicity. All connections between units are shown as simple lines, even if they are data lines, and it will be readily apparent which ones carry data. Conventional auxiliary components such as power supplies are omitted.

At the top of unit 7, hall sensor 11 is shown in its relationship with magnet 13 and arm 12 as in FIG. 1. When the centrifuge is running, hall sensor 11 and magnet 13 periodically move relative to each other as the result of imbalance, at least a small amount of which is almost always present. Hall sensor then produces an alternating output signal having the approximate form of a sine wave.

Line 20 carries the Hall sensor output signal to a peak-to-peak measuring circuit 21 which measures the peak-to-peak value corresponding to the amplitude of the output signal of sensor 11. This peak-to-peak value represents the actual amplitude measured by sensor 11. A signal representative of this peak-to-peak value is delivered on line 22 to an analog-to-digital converter circuit (ADC) 23 which converts the analog peak-to-peak value to a digital output signal on line 24.

A mode switch 25 connects the digitized value alternatively to either a line **24*a* or a line 24*b*, the mode switch being controlled by a signal on line 26 from keypad 10. In normal operation of the centrifuge, the mode switch connects line 24 to line 24*a***.

In this routine operation mode, the signal from ADC 23 is delivered to a comparator circuit 27 which compares the digitized peak-to-peak value with a stored value received on line 28 from a memory 29. Comparator 27 is chosen such that when the signal value on line **24*a* is greater than the value received on line 28 from the memory, the comparator produces an output signal on line 30 to a shutoff unit 31 which sends a switch controlling signal on line 32 to a power switch 33 in power line 34** to deenergize the motor of the centrifuge.

If keypad 10 is used to enter the calibration mode, the keypad sends a signal to mode switch 25 so that the output of ADC 23 is connected to line **24*b* and not to line 24*a***.

The keypad also sends a signal on a line 35 to an events timer 36 which counts three events. The timer starts with event 1 and displays via line 19 on display 9 a message asking the operator to load the centrifuge with a test weight of, for example, 2.9 g for the first test run. The operator does so and enters a "ready" on the keypad. The events timer also sends a signal to a switch 38 to connect the ADC output on line **24*b* via line 39 to a first memory 40**.

The first calibration run is then started. This can be done either manually using keypad 10 or it can be automated with additional components, not shown. When the timer stops the run, the peak-to-peak value determined by the first run is stored in memory 40.

The operator then changes the weight on the centrifuge to, for example, 2.2g , prompted by the events timer, and enters "ready". Event timer 36 then switches over to event 2 and changes switch 38 so that the ADC output is connected on line 41 to the second memory 42. The second peak-to-peak value is then stored, in a similar fashion, in second memory 42.

At the conclusion of run 2, timer 36 switches to event 3 and sends a signal on line 43 to an interpolation unit 44 which reads out on lines 45 and 46 the values stored in memories 40 and 42. A value between the first and second runs is then found by interpolation. If the weights used above are employed in the test runs, the resulting interpolated value will be equivalent to the amount of imbalance created by a weight between those two values and this value is stored in memory 29. Memory 29 is set so that a new value inserted into the memory on line 47 erases any value previously stored therein. The new value will then be used by comparator 27 for routine operation of the centrifuge.

The operator then enters "end" into the keypad which causes a signal on line 26 to return the mode switch to the position in which the ADC output is connected to line **24*a***.

As will be recognized, the electronic unit described herein can be realized by a variety of configurations of hardware or can be accomplished by a conventional computer with appropriate software.

What is claimed is:

1. A lab centrifuge comprising the combination of a base;

a centrifuge rotor comprising vessel supports and a motor with a vertical shaft driving said centrifuge rotor into rotation, said motor including a stator;

elastic support means supporting said motor and said stator on said base;

stator deviation detecting means including a stator-carried component and a component fixed to said base for detecting non-rotary stator deviation from a rest position and producing a signal indicating said deviation, one of said components comprising a field generator generating a constant field and the other component comprising a field intensity detector; and control means for supplying electrical power to said centrifuge, said control means including analyzer means responsive to said signal for deenergizing said centrifuge at a predetermined maximum permissible threshold deviation of said stator, said analyzer means including a calibration means for ascertaining a threshold amplitude of centrifuge rotor imbalance during calibration and storing said amplitude as a limit amplitude in a permanent memory of said analyzer means, and means for determining amplitudes of detected field intensity and comparing said amplitudes to said limit amplitude.

2. A centrifuge according to claim 1 wherein said field generator is a permanent magnet and said field detector is a Hall generator.

3. A centrifuge according to claim 1 wherein said field generator is affixed to said stator and said field intensity detector is affixed to said base.

4. A centrifuge according to claim 1 wherein said calibration means includes means for conducting two calibration procedures and for determining an interpolated value of two measured amplitudes determined from said calibration procedures for use as said limit amplitude.

5. A centrifuge according to claim 4 and further including first and second different test weights for selective attachment to said centrifuge rotor in said two calibration procedures.

6. A centrifuge according to claim 5 wherein one of said test weights is selected to cause an imbalance below said amplitude of centrifuge rotor threshold imbalance and the other test weight is selected to cause an imbalance above said amplitude of centrifuge rotor threshold imbalance.

* * * * *